United States Patent [19]

Weber et al.

[11] Patent Number: 4,662,895

[45] Date of Patent: May 5, 1987

[54] METHOD OF COOLING AND GASIFYING RETORT COAL

[75] Inventors: Heinrich Weber, Recklinghausen; Kurt Lorenz, Hattingen; Horst Dungs, Herne, all of Fed. Rep. of Germany

[73] Assignee: Firma Carl Still GmbH & Co. K.G., Fed. Rep. of Germany

[21] Appl. No.: 732,084

[22] Filed: May 9, 1985

Related U.S. Application Data

[63] Continuation of Ser. No. 306,428, Sep. 28, 1981, abandoned.

[30] Foreign Application Priority Data

Oct. 4, 1980 [DE] Fed. Rep. of Germany ..... 3037564
Mar. 17, 1981 [DE] Fed. Rep. of Germany ..... 3110191

[51] Int. Cl.[4] ..... C10J 3/02; C10B 39/02

[52] U.S. Cl. ..... 48/210; 201/6; 201/22; 201/39

[58] Field of Search ..... 201/6, 22, 39, 42; 202/228; 48/197 R, 202, 210; 44/10 C

[56] References Cited

U.S. PATENT DOCUMENTS 1,593,698 7/1926 Illingworth ..... 201/39
1,950,017 3/1934 Zwoyer et al. ..... 201/39

FOREIGN PATENT DOCUMENTS 472803 2/1929 Fed. Rep. of Germany .

*Primary Examiner*—Peter Kratz
*Attorney, Agent, or Firm*—McGlew and Tuttle

[57] ABSTRACT

A method and apparatus of cooling retort coke is disclosed which provides for cooling hot coke from a coking chamber by direct heat exchange with fine-grained material, preferably coal, and the subsequent separation of the fine-grained material from lump coal which would form the cooling step.

4 Claims, 3 Drawing Figures

METHOD OF COOLING AND GASIFYING RETORT COAL

This is a continuation of application Ser. No. 306,428 filed Sept. 28, 1981 now abondoned.

FIELD AND BACKGROUND OF THE INVENTION

The present invention relates to a method of cooling retort or chamber coke.

Aside from the conventional wet quenching where, as a rule, the sensible heat of the coke is not utilized at all, or recovered only to a very small extent, dry cooling of coke is known in which the heat of the retort or chamber coke having a temperature of about 1,000° C. is removed by a circulated gas and utilized in a waste heat boiler for producing steam. It is further known to use this steam for preheating the moist coking coal, with the heat being transferred to the coal, for example, in a fluidized bed or rotary drum drier through suitable heating surfaces (see German patent application Nos. P 30 13 325.6 and P 30 34 952, U.S. Pat. Nos. 4,354,903 and 4,422,858, respectively, which are here incorporated by reference).

It is also known to supply the chamber coke having a temperature of about 1,000° C. to a first cooling and gasification stage for partial degasification under the addition of steam and to cool it down to 500°-800° C., and then to direct it through a pressure metering system to a pressure-type gasifier where it is gasified by fixedbed gasification while adding air or oxygen, and steam (German application No. P 30 32 212.4 or U.S. Pat. No. 4,422,858 also incorporated by reference).

With such coke cooling methods, the produced steam can only be employed for preheating the coal to be coked, in view of the heat economy of the coking plant. Exceptionally, a power plant may be in the neighborhood of the coking plant, where the steam from the dry coke cooling may be used for generating power. However, this is not the case as a rule. Further, if the steam is employed for preheating moist coking coal, as usual, only superheated steam is used for transferring the heat to the coal through indirectly heated surfaces. This means that, as compared to the relatively high temperature of about 1,000° C. of the coke coming from the chambers, the heat is utilized at a relatively low temperature level (t=232° C. at 30 bar, or t=249° C. at 40 bar) large heat exchanger surfaces or, in addition, special and very expensive measures must be provided (such as a fluidized bed) for improving the heat transfer.

SUMMARY OF THE INVENTION

The present invention is directed to a novel improved method of cooling hot retort coke with an elevated thermal efficiency as compared to known methods, also involving and improving other operations of coal and coke treatment.

Accordingly, it is an object of the invention to provide a method of cooling retort coke, comprising, cooling hot coke from a coking chamber by direct heat exchange with a fine-grain material, preferably coal, and separating the fine-grain material from lump coke which has been formed during the cooling operation.

Due to the direct heat exchange from solid to solid, the heat is transferred almost without losses, without the necessity of interposing an additional transfer medium. No power for circulating the gas, nor dust separating and heat exchanging devices are needed. Instead, the hot coke and the fine-grained material are supplied to the cooling stage and mixed with each other, and later separated from each other again by means of a screen.

In accordance with the invention, it is particularly advantageous to employ a moist or preheated, non-caking, preferably highly volatile fine coal as the fine-grained material. Then, the drying, heating, and low-temperature carbonization of this coal can be combined in a simple and effective manner with the cooling of the coke. The use of such coal is particularly economical since alone, it cannot be charged into conventional coke oven chambers.

In accordance with the invention, the coke cooling may also be combined with a gasification, by cooling the retort coke having a temperature of 900° to 1,100° C. by direct heat exchange with the fine coal to about 650° C. and then supplying it through a pressure metering system to a pressure-type gasifier, for gasification in accordance with German patent application No. P 30 32 212.4. This makes it possible to carbonize a certain amount of fine coal at low temperatures until a tarless low-temperature coke is obtained. On the other hand, the cooling to a temperature of 650° C. offers the advantage that the charging of the coke into the following pressure gasification becomes much less problematic, with regard to construction materials and sealing, than at temperatures around 1,000° C.

The invention further provides that the cooling of the retort coke is effected by a direct heat exchange in two or more stages, and that the fine-grained material and the lump coke are separated again from each other after each of the stages. Such a multi-stage cooling is particularly economical and allows a more accurate adjustment of the temperatures, primarily in view of the further use of the coke, of the coal to be heated, and of the produced gases.

The inventive method is particularly advantageous if the coke is cooled in a first stage from 900° to 1,100° C. to about 650° C., and in a second stage down to about 300° C., and the moist fine coal is dried and preheated to 150°-250° C. in the second stage and heated to about 600° C. and widely degassed in the first stage, whereby fine-grained low-temperature coke is produced. It may be provided initially to remove the moisture from the coal in the lower-temperature stage, with the produced steam being substantially free from volatile matter and capable of being further treated without expensive equipment, and then to further heat the coal in the higher temperature stage, to expel the volatile matter and completely remove the tar content.

Also, in order to utilize the sensible heat of the coke, the retort coke having a temperature about 300° C. after the second stage may be supplied through a pressure-metering system to a pressure-type gasifier, for gasification in accordance with No. P 30 32 212.4. It has further been found advantageous to separate the hot low-temperature coke, obtained after the first stage, along with the coke fines of the retort coke, up to a grain size of 10 mm, preferably 5 mm. The hot lump coke thus eliminates, to a large extent, the coke fines which frequently are disturbing in further treatments.

It is also particularly advantageous for further use, to mix the mixture of low temperature coke and coke fines having a temperature of about 600° C., with fat coal having a temperature of about 320° C., and to form this material into briquettes at a temperature of 450°-500° C.

Since in prior art hot-briquetting methods, the production of hot low-temperature coke requires considerable equipment and power, this inventive combination with hot briquetting is very advantageous.

Both in the hot-briquetting process and during the first stage cooling, a crude gas is obtained having a relatively high calorific value. It is therefore advisable to treat the tar and dust containing rich gas obtained in the hot-briquetting process together with the rich gas obtained in the first stage, in a common gas cleaning stage.

The briquettes produced in the hot briquetting process, which are substantially tar-less, might be cooled in the conventional way and used as domestic fuel or in a blast furnace. However, the invention provides, in addition, a particular utilization, namely to supply these briquettes having a temperature of about 450° C. through a pressure metering system to a pressure-type gasifier for gasification in accordance with German patent application No. P 30 32 212.4. Thereby, the heat of the hot coke can again be almost completely utilized.

Additional modifications in utilizing the low-temperature coke are obtained in accordance with the invention during the coke-cooling process, such as using a leaning agent for treating coals which alone are not suitable for being charged into coke oven chambers. Particularly, if a low-temperature coke thus produced is employed for leaning coking coals having a coking capacity in excess, a strong lump coke is obtained. This method makes it possible to process an amount out of proportion of highly volatile and poorly caking coals, to a lumpy and abrasion-resistant coke. The low temperature coke is obtained in accordance with the invention and the coke fines obtained by separation from the retort coke are fragmented together to a grain size where 90–100% of the grains are in the range of less than 1 mm, and added in a proportion of 5–40%, preferably 10–20%, as a leaning agent to the caking coal.

The properties of the leaning agent (for example, residual volatile matter, porosity, etc.) may advantageously be influenced or changed by varying, for example:

the final temperature of the leaning agent at the outlet of the heat exchanger;

the dwell period of the low-temperature coke in the heat exchanger;

the temperature of the employed highly volatile fine coal (moist, dried, or preheated);

the proportion of the hot retort coke to the used fine coal.

The leaning agent prepared in accordance with the invention together with the moist caking coal are either briquetted or compacted by tamping and then supplied to chamber carbonization.

The inventive leaning agent may also advantageously be heated along with the coking coal to 70°–150° C. and dried, mixed with an organic binder and partly or entirely briquetted, and then supplied to chamber carbonization. Such a method is known from German Pat. No. 26 40 787.4 U.S. Pat. Nos. 4,142,941 and 4,158,550. For compacting by tamping, it has been found useful to mix the inventive leaning agent with fine coal, heat the mixture to 100°–300° C., add an organic binder, compact the material to 1.0 t/m$^3$, and supply it to the chamber carbonization.

According to the development of the invention, it is particularly advantageous to provide another screening, instead of the fragmentation of the leaning agent, and to use the coarse fraction (grain size of about 1 to 5 mm) as a fuel for sintering and the fine fraction (grain size about 0 to 1 mm) as the leaning agent. If, in the inventive production of low-temperature coke, the retort coke is separated from the low-temperature coke and the coke fines by screening out a grain size up to 10 mm or more, it is advantageous to break up the coarse fraction over 5–6 to a size below 5–6 mm and to split it in another screening device again into a coarse fraction (about 1 to 5 mm) to be used as fuel for sintering, and a fine fraction (about 0 to 1 mm) to be used as the leaning agent.

Surprisingly, experience has shown that the inventive heat exchange between the hot lump coke from the oven chambers and the fine coal can best be effected in a rotary tube. This ensures a particularly intense mixing of the two components to be brought into contact and the process can simply be controlled through the rotational speed of the tube.

In the following, the inventive method is described in more detail with reference to the accompanying diagrammatical drawings illustrating each of several possible combinations for utilizing the heat energy, while, of course, in a specific case, any of the combinations may be applied individually.

For an understanding of the principles of the invention, reference is made to the following description of typical embodiments thereof as illustrated in the accompanying drawings.

DESCRIPTION OF THE PREFERED EMBODIMENTS

Figure 1:
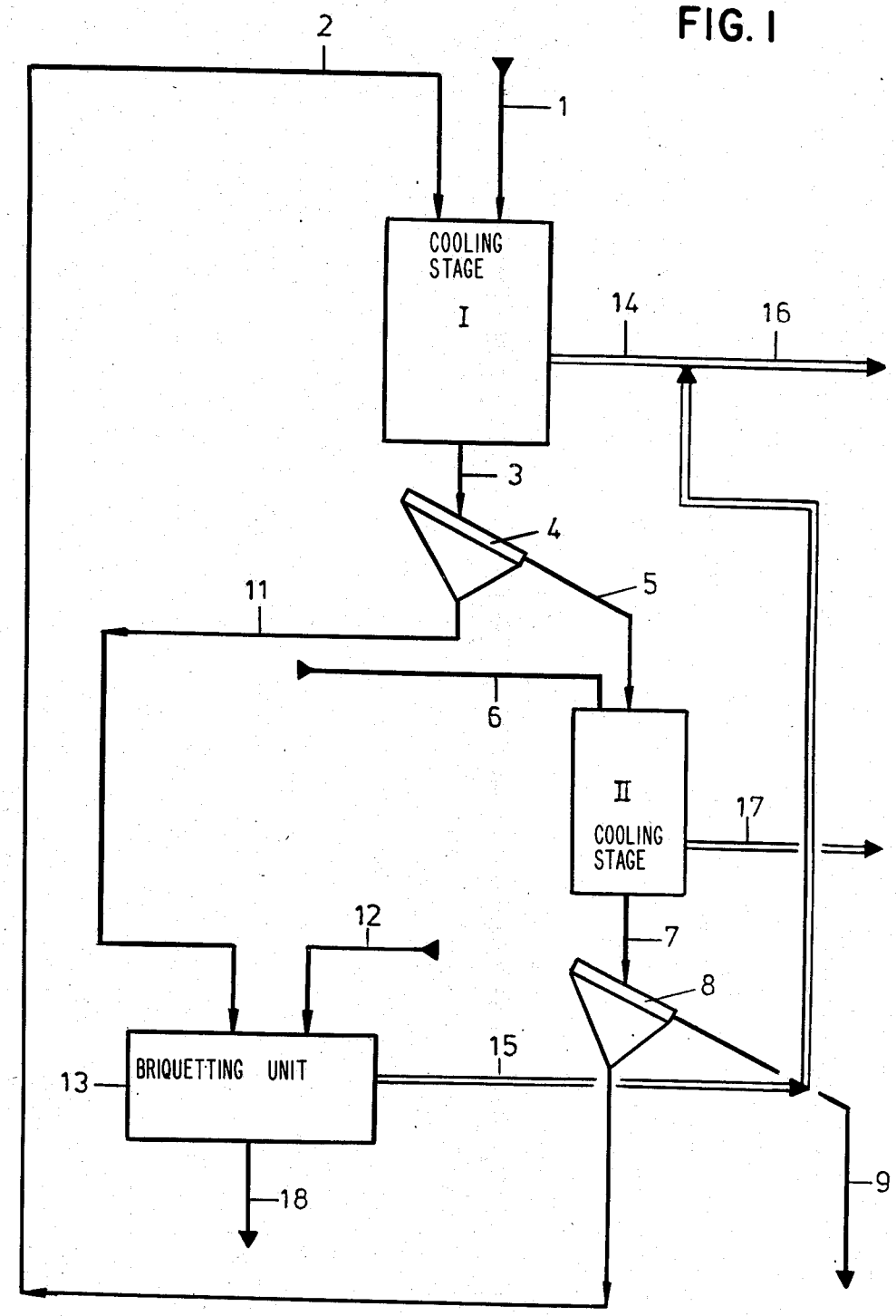
FIG. 1 is a schematic diagram of apparatus for a heat exchange in two stages, in combination with the use of the low-temperature coke for hot-briquetting according to the invention.

In FIG. 1, the two stages in which the hot coke is cooled by direct heat exchange with the fine coal, are indicated at I and II. These cooling stages may be designed as rotary tubes or as shaft furnaces, for example. The hot unbriquetted chamber retort coke is fed in at 1 and mixed in this first stage with preheated coal which is supplied by conveying means 2. The mixture passes through outlet 3 from stage I to a screen grating 4 where the grain size below 5 mm of the low-temperature coke and the coke fines produced by abrasion, are separated before the lump coke is directed over a feeder 5, to stage II. By conveying means 6, moist coal is supplied to stage II where it is dried and preheated, with the water vapors thereby produced being evacuated at 17 and further treated in a simple manner. After the effected heat exchange, the coal-coke mixture passes through line 7 to a screen grating 8. The oversize lump coke is directly supplied to the pressure metering system of a pressure-type gasifier (not shown) overline 9. The separated preheated coal may be recycled through conveyor 2 to stage I, to be further heated and processed to low-temperature coke. The fine fraction of low-temperature coke and coke fines which is separated by screen 4, is directed through a line 11 to a hot-briquetting unit 13 to which 30% of the preheated fine coal is also supplied through line 12. The produced hot briquettes are also directly supplied through 18 to the pressure-type gasification (not shown).

The crude gas produced during the mixing prior to hot briquetting in 13, is directed through a line 15 to line 14 where it unites with the crude gas removed from stage I to be discharged to common gas cleaning equipment (not shown).

EXAMPLE

Hot coke in an amount 170 t per hour and having a temperature of 1000° C., and fine coal (40% waf of volatile matter) in the amount of 125 t and preheated to 235° C., are fed into stage I. During mixing and direct heat exchange, a crude gas with a high colorific value is produced which is removed over line 14, while having a temperature of 700° C. and a content of about 20.2 t per hour of tar, 11.2 t per hour of gas, and 5.6 t per hour of water vapor. After screening out the fine-grained material at 4, 153 t of lump coke having a temperature of 630° C. and 140 t of moist coal containing 15 t of water, are fed into stage II. Upon drying and preheating, the water is completely vaporized so that about 15 t of water vapor having a temperature of 350° can be removed. While the preheated coal is directed to stage I, the 153 t of coke having a temperature of 315° C. are available for the gasification.

After stage I, 105 t of low-temperature coke and coke fines having a temperature of 600° C. remain on the screen for the hot briquetting process at 13, to which 44 t of fine coal (25% waf of volatile matter) with a temperature of 320° C. are admixed.

The rich gas thereby produced and supplied over line 15, has a temperature of 500° C. and contains hourly about 2 t of tar, 1.2 t of gas, and 0.2 t of water vapor. Hot briquettes in an amount of 145.6 t and having a temperature of about 180° C. can be gasified together with the remaining retort coke.

Figure 2:
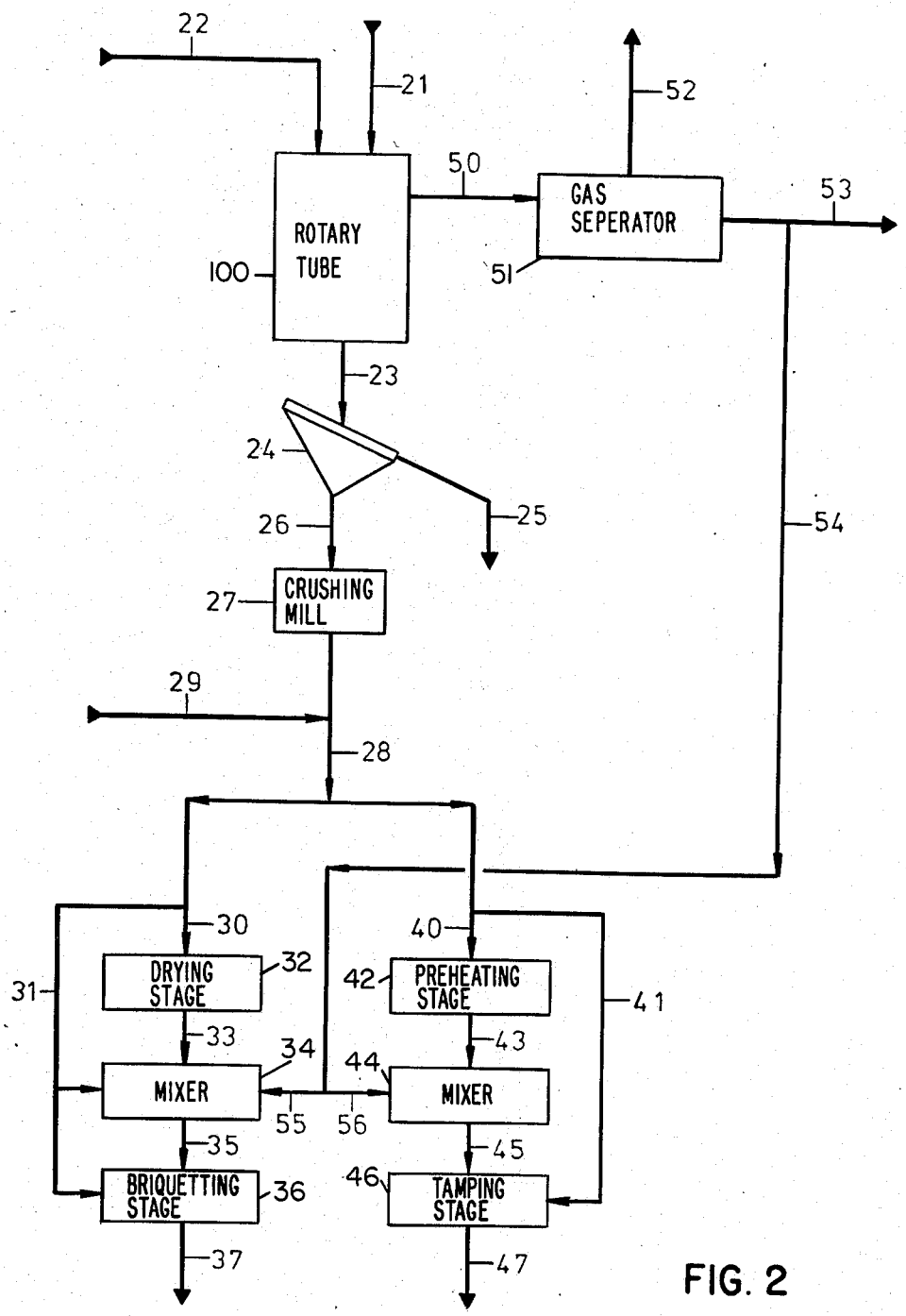
FIG. 2 is a schematic diagram of apparatus for a single stage heat exchange between the hot retort coke and the high-volatile fine coal, the separation of the lump coke from the low-temperature coke and the coke fines, the following fragmentation of the low-temperature coke and its use as a leaning agent, in combination with the briquetting and the compaction by tamping for charging into a coking chamber.
Figure 3:
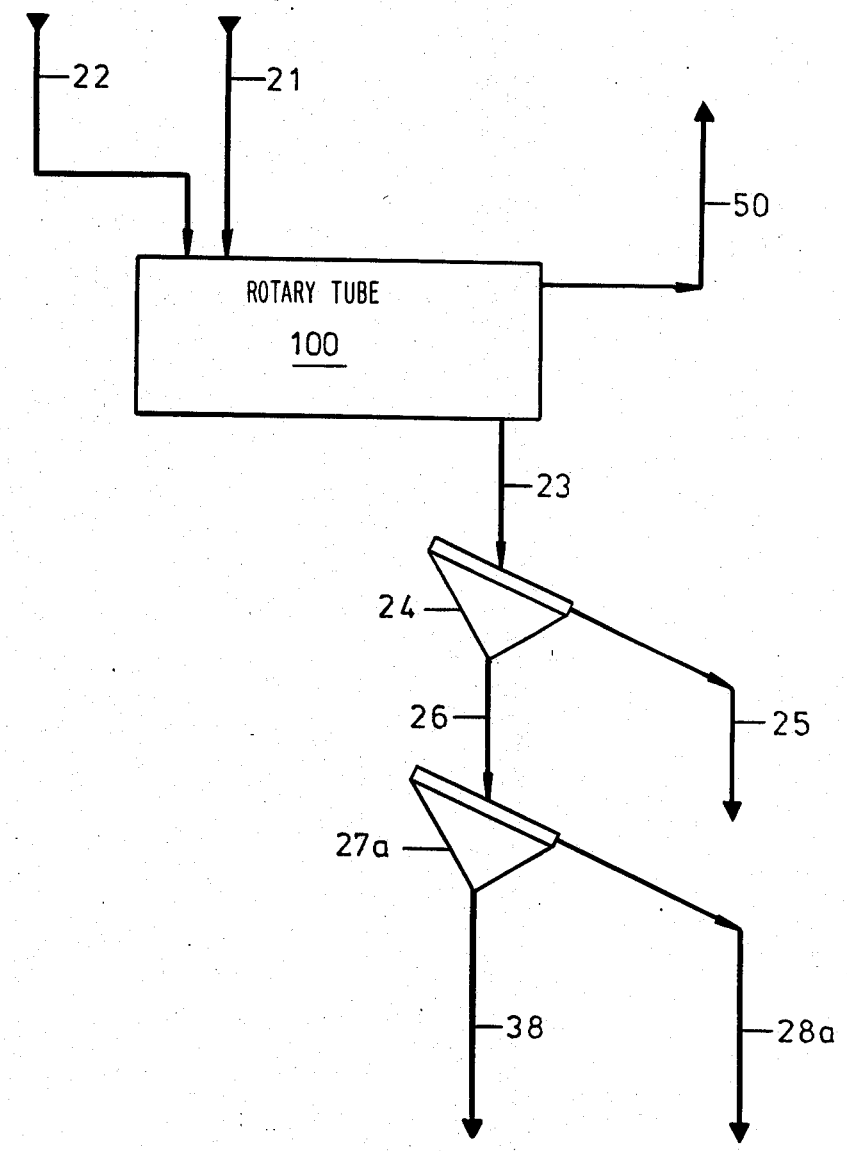
FIG. 3 is a schematic diagram of apparatus for providing another screening instead of breaking up of the leaning agent, to obtain a sintering fuel with a grain size of about 1 to 5 mm, and a leaning agent with a grain size of about 0 to 1 mm.

In FIGS. 2 and 3, the supply of the hot retort coke having a temperature of 1,000° C., and the supply of the non-caking, preferably highly volatile fine coal (moist or preheated) to rotary tube 100, are shown at 21 and 22, respectively. After the heat exchange, the mixture is supplied through outlet 23 to a screen grate 24 where the grain size of 5 mm and less of the hot low-temperature coke and the coke fines of the retort coke are screened out over line 26. After an intermediate cooling, the low-temperature coke is fragmented in a crushing mill 27 (FIG. 2) to a grain size of 90–100% smaller than 1 mm, and then mixed, as a leaning agent, with the normal coking coal which is supplied through 29, and directed through 28 to further use. In principle, several alternatives are possible. The leaning agent containing coke-coal mixture may be supplied through 30 to drying stage 32 and through 33 to a mixer 34, with the binder (low-temperature tar) being admixed at 55. The mixture passes through 35 to the briquetting stage 36 and after briquetting, is supplied at 37 to the chamber carbonization. The drying stage 32 may also be bypassed and the moist leaned coke-coal mixture may be supplied through 31 directly to mixer 34 or to the briquetting station 36. Alternatively to briquetting, the leaned coke-coal mixture may be supplied through 40 to a preheating stage 42 and through 43 to a mixer 44, with the binder (low-temperature tar) being admixed at 56. The mixture passes through 45 to a tamping station 46 where it is compacted and the compacted cake is directed at 47 to the chamber carbonization. The preheating stage 42 may also be bypassed and the moist leaned coke-coal mixture is then supplied through 41 directly to the tamping station 46.

The tar containing crude gas produced in the rotary tube during the heat exchange is removed through line 50, while the low-temperature tar or the higher boiling fractions thereof are directed through lines 54 to 56 to the mixers where the binder is added, with the low-temperature tar in excess is available for further use at 53. A gas separator 51 supplies the separated gas to line 52 and the reminder of the tar is supplied to line 53.

In FIG. 3, a second screening station 27*a* is provided downstream of screen grate 24 instead of crushing mill 27 shown in FIG. 2, with the mixture of low-temperature coke and coke fines being removed at 28*a* as a fuel for sintering (grain size about 1 to 5 mm) and at 38 as a leaning agent (grain size about 0 to 1 mm).

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

What is claimed is:

1. Method of cooling unbriquetted retort coke from a coke oven chamber, comprising supplying the retort coke at substantially 1,000°–1,100° C. to a first transfer stage for direct heat exchange, supplying fine-grained coal containing high calorific gaseous and tar constituents and which has been preheated to substantially 150°–250° C., to the first transfer stage for direct mixing and direct heat transfer with the retort coke to form partially cooled lump coke at substantially 650° C., and to drive off the high calorific gaseous and tar constituents from and carbonize the fine-grained coal and correspondingly form low temperature carbonized fine-grained coke at about 600° C. and hot high calorific crude gas containing such gaseous and tar constituents, recovering the hot crude gas from the first transfer stage, supplying the mixed lump coke at substantially 650° C. and so carbonized fine-grained coal at about 600° C. from the first transfer stage to a first screen separater stage to screen separate from the lump coke the carbonized fine-grained coal, supplying the lump coke from the first screen stage to a second transfer stage for further direct heat exchange, supplying moist fine-grained coal containing high calorific gaseous and tar constituents to the second transfer stage for direct mixing and direct heat transfer with the lump coke and in sufficient amounts to further cool the lump coke to about 300° C., and to drive off moisture from the fine-grained coal and correspondingly form preheated moisture depleted fine-grained coal at substantially 150°–250° ,C. and water vapor, removing the water vapor from the second transfer stage, supplying the mixed further cooled lump coke at about 300° C. and preheated fine-grained coal at substantially 150°–250° C. from the second transfer stage to a second screen separater stage to screen separate from the further cooled lump coke the preheated fine-grained coal, supplying the further cooled lump coke from the second screen stage in a continuous process to a pressure metering system and a pressure-type gasifier for gasification of the lump coke, and returning the preheated fine-grained coal at substantially 150°–250° C. from the second screen stage to the first transfer stage.

2. Method of claim 1 wherein the carbonized fine-grained coal is recovered from the first screen stage at about 600° C. and mixed with preheated fine-grained coal sufficiently to drive off the high calorific gaseous and tar constituents from the fine-grained coal and correspondlingly form a solids mixture of such fine-grained coals and hot calorific crude gas containing such gaseous and tar constituents, recovering the hot crude gas, forming briquettes from the solids mixture, and supplying the briquettes to the pressure metering system and pressure-type gasifier for gasification of the briquettes.

3. A method according to claim 1, wherein after the first stage, the lump coke and the carbonized fine-grained coal are separated up to a grain size of 10 mm.

4. A method according to claim 3, wherein the lump coke and the carbonized fine-grained coal are separated to a grain size of 5 mm.

* * * * *